United States Patent [19]

Uebel

[11] Patent Number: 4,469,298

[45] Date of Patent: Sep. 4, 1984

[54] AXLE SENSOR

[75] Inventor: Helmut Uebel, Leonberg, Fed. Rep. of Germany

[73] Assignee: International Standard Electric Corporation, New York, N.Y.

[21] Appl. No.: 323,143

[22] Filed: Nov. 19, 1981

[30] Foreign Application Priority Data

Dec. 6, 1980 [DE] Fed. Rep. of Germany ..... 3046103

[51] Int. Cl.[3] ..... B61L 11/08; B61L 13/04

[52] U.S. Cl. ..... 246/249; 246/28 K; 246/34 CT; 246/122 R; 246/125

[58] Field of Search ..... 246/34 CT, 249, 247, 246/250, 122 R, 28 K, 125, 128, 130, 40; 340/38 L, 941; 324/208

[56] References Cited

U.S. PATENT DOCUMENTS

| | | | |
|---|---|---|---|
| 2,892,078 | 6/1959 | Orthuber | 246/249 |
| 2,993,116 | 7/1961 | Utt | 246/130 |
| 3,752,426 | 8/1973 | Pal | 246/249 |
| 4,200,855 | 4/1980 | Gilcher | 246/249 |
| 4,392,626 | 7/1983 | Pascoe | 246/34 CT |

*Primary Examiner*—James J. Groody

*Attorney, Agent, or Firm*—John T. O'Halloran; Alfred C. Hill

[57] ABSTRACT

A sensor arrangement is disclosed for detecting the presence of an axle of a rail vehicle in a short length of a track. The arrangement includes a bridge coupled to and including resistances of the rail upon which the vehicle travels. This bridge is unbalanced by wheels of an axle shunting resistance of the bridge with the bridge unbalance producing an output indicative of the presence of the axle. Two such arrangements displaced relative to each other will enable detecting the direction of movement of the vehicle. This sensor arrangement contains no electric components on the rail and is insensitive to interference from rail currents and electromagnetic rail brakes.

17 Claims, 5 Drawing Figures

AXLE SENSOR

BACKGROUND OF THE INVENTION

The present invention relates to a sensor arrangement for detecting the presence of a single axle of a rail vehicle in a short length of a track and to the arrangement of two or more such sensor arrangements along the track.

Such sensor arrangements are used as axle detectors at counting points of axle-counting installations. They must safely detect all axles of a rail vehicle, even if these are spaced short distances apart, as in trucks, and if the vehicle travels at high speed.

So far, axle detectors have mainly employed magnetic sensing devices, which sense a change in a magnetic circuit caused by wheel flanges and tires. These conventional sensing devices are usually attached in pairs to both rails of a track and displaced a few centimeters in relation to one another, so that the passage of an axle causes two axle pulses to be provided which are are shifted in time with respect to each other and whose order is used to additionally determine the direction of movement of the axle (see, for example, an article by G. Frech and K. Schmidt in "Signal und Draht" 59 (1967), No. 11, pp. 165–174).

The conventional axle detectors are permanently connected with the rail. As a result, rail vibrations, which may reach very high acceleration rates, may be transmitted to the respective axle detector. Accordingly, costly and complicated fastening and adjusting elements are required to insure that the mechanical action does not lead to a change in the magnetic circuit. Strong vibrations may also damage the electric components in the axle detector and result in failures. Finally, a magnetic axle detector is sensitive to interference caused by metallic parts hanging down from vehicles, such as electromagnetic rail brakes. To insure that such an axle detector safely responds to each wheel but does not react to electromagnetic rail brakes, precise electrical adjustment is necessary, which ensures error-free operation only if the electromagnetic rail brakes do not hang down from the vehicles too far.

SUMMARY OF THE INVENTION

An object of the present invention is to provide an axle sensor that overcomes the unavoidable disadvantages of the magnetic axle detector.

Another object of the present invention is to provide an axle sensor that contains no electric components directly on the rail and detects the presence of an axle with the aid of a characteristic which an electromagnetic rail brake cannot have.

A feature of the present invention is the provision of a sensor arrangement for detecting the presence of a single axle of a rail vehicle in a short length of a track having two rails comprising: a first shunt path having two ends each coupled to a different one of first and second points spaced along one of the two rails within the short length of the track; a first transformer having a first secondary winding and a first primary winding having one end thereof connected to a third point on the one of the two rails between the first and second points and the other end thereof connected to the first shunt path to provide one diagonal of a first bridge circuit including electrical resistances of the first shunt path and electrical resistances of the one of the two rails between the first and second points; an alternating-current source connected between the two rails to provide the other diagonal of the first bridge circuit and to feed alternating current having a predetermined frequency into the first bridge; and the first secondary winding having a first alternating-voltage signal developed thereacross when the first bridge is unbalanced by a wheel of the axle being present between the first and second points.

Instead of using the magnetic properties of the wheels, the sensor arrangement according to the present invention senses the short-circuiting effect which each axle has on the two rails of a track (axle short circuit). Thus, this sensor arrangement has a certain resemblance to the conventional track circuit in which the short-circuiting effect of axles is used to provide an occupancy indication for a larger track section. Unlike the conventional track circuit, however, the sensor arrangement according to the present invention is an intermittent arrangement and provides axle-counting pulses. The circuit of the sensor arrangement of the present invention differs considerably from conventional track-circuit variants. If, in the sensor arrangement according to the present invention the rail portion shunted by the shunt path is passed by an axle, the bridge formed by the shunt path and the transformer winding, which bridge is balanced in the absence of axles, will be unbalanced as soon as the axle is over the shunted rail portion, because the axle represents a shunt path for the alternating current fed into the bridge. The current then flowing through the primary winding of the transformer is a measure of the degree of unbalance and induces an interpretable voltage in the secondary of the transformer.

Since all currents flowing in the rail have an equal effect on all bridge resistors, at least on pairs thereof, the sensor arrangement according to the present invention is insensitive to traction return currents. Any change in ballast resistance has practically no effect, either, since the ballast resistance acts on both portions of the shunted rail section approximately alike and, in addition, is not low enough to produce a shunting effect.

The bridge may have two series resistances in the shunt path thereof in the form of resistors or inductors with the cross-connection terminal at the shunt path being located between the two resistances.

It is especially simple to provide resistors implemented by a common wire along which the terminal of the cross connection is slidable for balancing the bridge.

If inductors are to be employed, a tapped choke is advantageously inserted in the shunt path. If bridge alternating current of sufficiently high frequency is used, it is also possible to use capacitances as bridge resistances in the shunt path.

A further feature of the present invention is to have the alternating-current source connected to both rails with these two points of connection being displaced relative to each other. This enables the bridge alternating current to be fed to the bridge without the need of laying any additional cables. The feed points are displaced relative to one another so as to prevent the alternating-current source from being short-circuited by an axle. Here the bridge current flows through existing bonds or connections between the rails designed to compensate for traction return currents.

Another feature of the present invention is to have such bonds installed directly in front of and behind the sensor arrangement to limit the range of the alternating current along the track.

Still a further feature of the present invention is the provision of two or more sensor arrangements of the present invention displaced relative to one another along the track in the same manner as conventional magnetic sensors to provide signals which are shifted in time with respect to each other and whose order can be used to determine the direction of movement of an axle.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
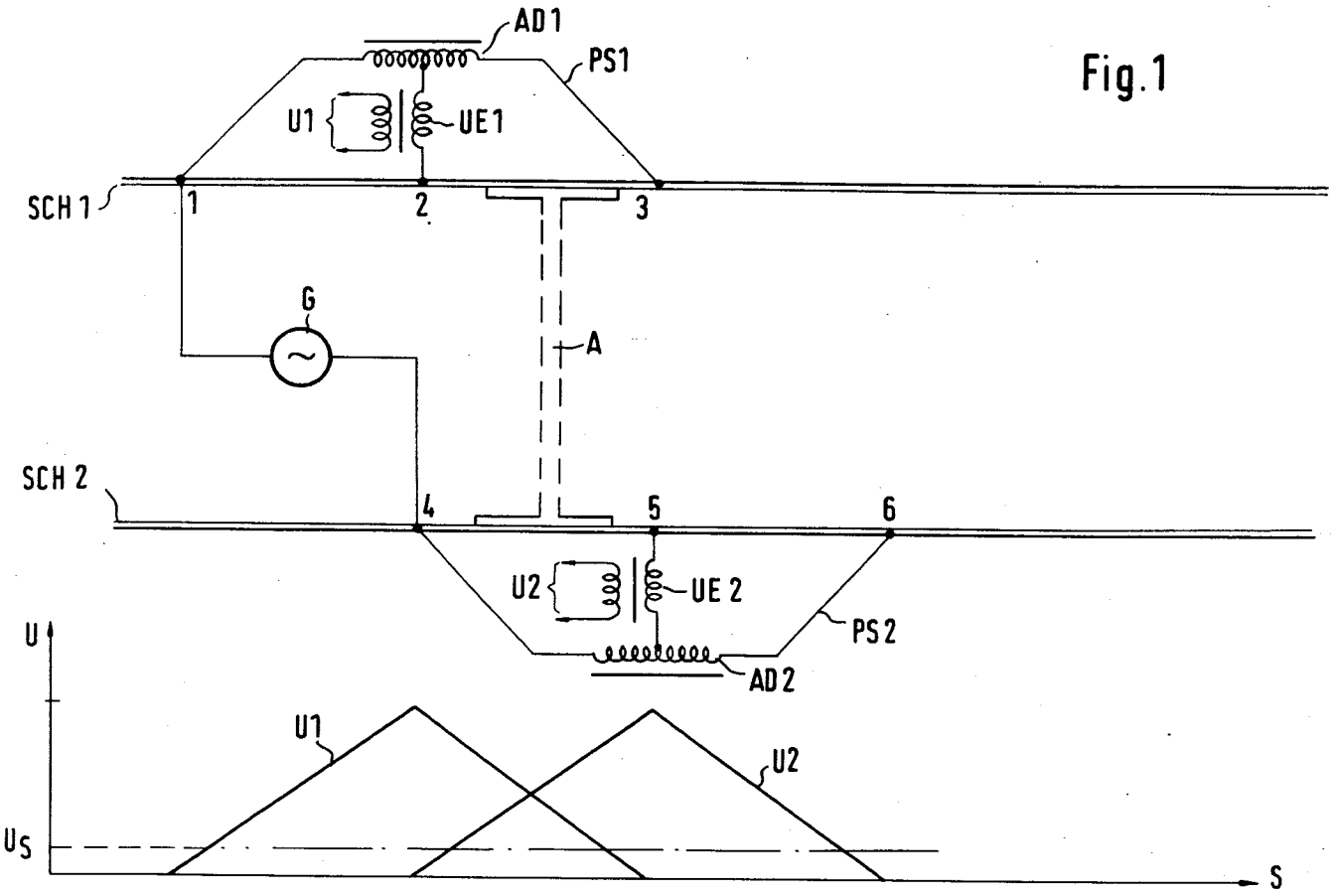
FIG. 1 shows a first embodiment of two sensor arrangements according to the principles of the present invention displaced relative to one another, and the shape of the signal voltages generated by these two sensor arrangements.

FIG. 1 shows the two rails SCH1 and SCH2 of a track and an axle A thereon. Associated with each rail is a sensor arrangement in accordance with the principles of the present invention. The arrangement associated with the rail SCH1 comprises a shunt path PS1, which runs from a rail point 1 via a tapped choke AD1 to a rail point 3, and a transformer UE1, whose primary winding is connected to the tap of the choke AD1 and to the rail at a point 2 located about in the middle between the two rail points 1 and 3. The terminals of the transformer's secondary windings are connected to an evaluating circuit (not shown). The sensor arrangement associated with the rail SCH2 is of analagous construction and comprises a shunt path PS2 including a choke AD2 and a transformer UE2. This sensor arrangement is displaced relative to the sensor arrangement associated with the rail SCH1. The sensor arrangements are fed in common from an alternating-current source G having a first output terminal connected to the rail point 1 and a second output terminal connected to the corresponding rail point 4 of the other rail. In the absence of axles, the alternating current flows from the rail point 1 partly into a circuit located on the left of the current source—this circuit comprises parts of both rails and an electric connection between the two rails, such as connection SV1 in FIG. 3—and partly into a circuit located on the right of the current source. The latter circuit contains both sensor arrangements, parts of the rails, and an electric connection between the two rails outside the area of the sensor arrangements, such as connection SV2 in FIG. 3. In the area of each sensor arrangement, the current flowing through the sensor arrangements divides into a part remaining in the rail and a part flowing over the shunt path. If, for example, the primary winding of the transformer UE1, which forms part of the sensor arrangement associated with the rail SCH1, is so connected to the rail that the ratio of the resistances of those parts of the shunt path located on both sides of the tap of choke AD1 is equal to the ratio of the resistances of the rail portions from the rail point 1 to the rail point 2 and from the rail point 2 to the rail point 3, these resistances form a balanced bridge one diagonal of which is the primary winding of the transformer UE1, which primary winding carries no current at balance. When the primary winding carries no current, the secondary winding of the transformer provides a zero signal.

When an electrically conductive axle moves through the sensor-arrangement areas from the left to the right, for example, it forms an electric shunt to one of the bridge resistances. It influences first the sensor arrangement associated with the rail SCH1 and then, after passing the rail point 2, the sensor arrangement associated with the rail SCH2 by unbalancing the balanced bridges one after the other. The unbalancing causes currents to flow through the primary windings of the transformers U1 and U2 which, in turn, provide alternating voltages U1 and U2 at the outputs of the secondary windings.

As the variation of the alternating voltages U1 and U2 developed across the secondary windings and indicating the degree of influence with the position of the axle shows, the strongest influence is exerted when the axle is at the location of the point of connection of the transformer primary to the rail, namely, points 2 and 5. The influence decreases linearly both sides of this point.

Figure 2:
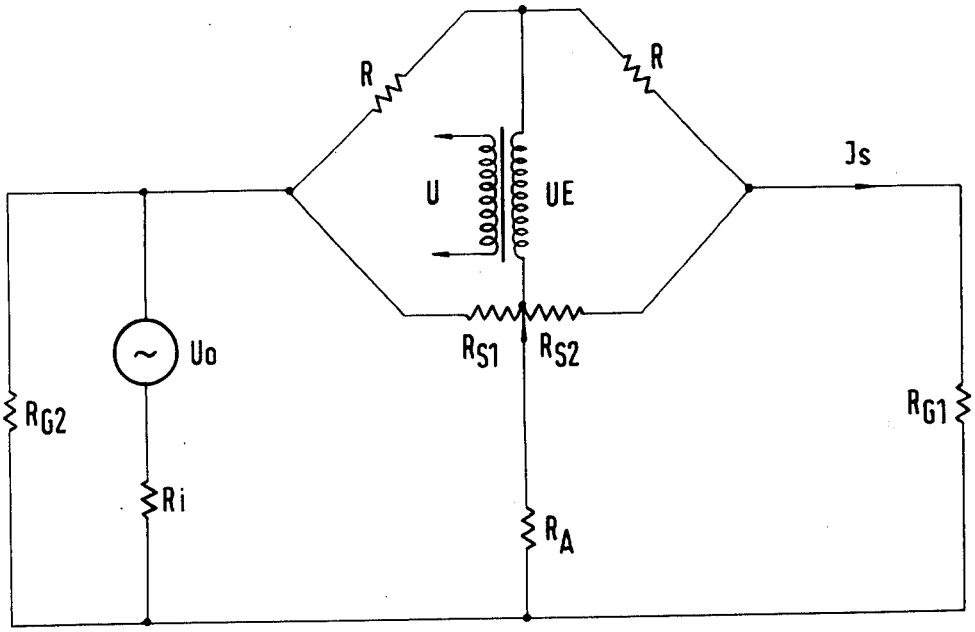
FIG. 2 is an equivalent circuit diagram of one of the sensor arrangements of FIG. 1.

FIG. 2 shows the equivalent circuit of one of the sensor arrangements of FIG. 1 with resistors R in the shunt path. The resistors R of the shunt path are of the same value and form two of the bridge resistances. The two other bridge resistances $R_{S1}$ and $R_{S2}$ are the resistances of the rail portions on the right and left of the point of connection of the transformer primary winding to the rail, namely, points 2 and 5. The alternating-voltage source provides a voltage $U_o$ and has an internal resistance $R_i$. The resistances of the rail portions and bonds or connections between the rails lying outside the area of the sensor arrangement are represented as track resistances $R_{G1}$ and $R_{G2}$. The axle resistance is represented by a resistor $R_A$, one terminal of which is moved over the interconnected resistors $R_{S1}$ and $R_{S2}$ like the sliding contact of a potentiometer and establishes the shunt to the opposite rail. It is clearly apparent from the circuit diagram that any change in bridge current $I_s$, e.g. due to influences exerted by traction currents, can have no effect on the bridge balance. The axle resistance $R_A$, however, causes the current through the resistor $R_{S1}$ to be greater than that through the resistor $R_{S2}$, whereby the bridge is unbalanced. Current then flows through the bridge diagonal, i.e., the primary winding of the transformer UE, and an alternating voltage U appears across the secondary winding.

Figure 3:
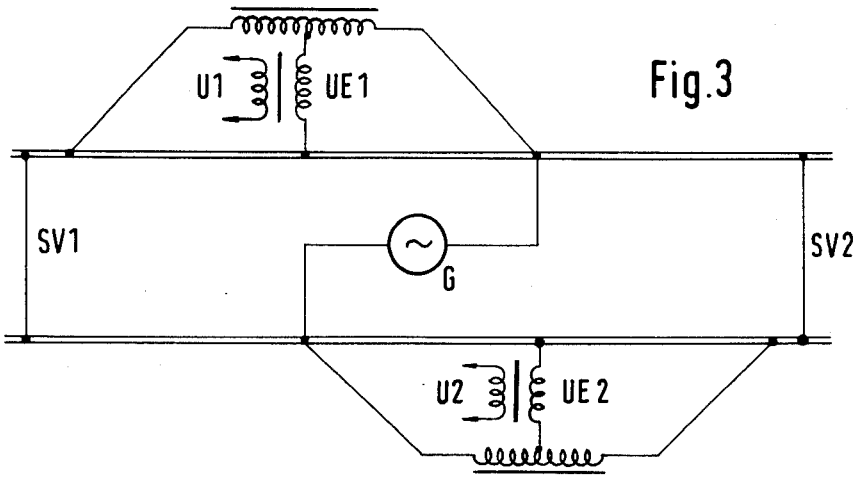
FIG. 3 shows a second embodiment of two sensor arrangements according to the principles of the present invention displaced relative to one another including tapped chokes and range-limiting means.
Figure 4:
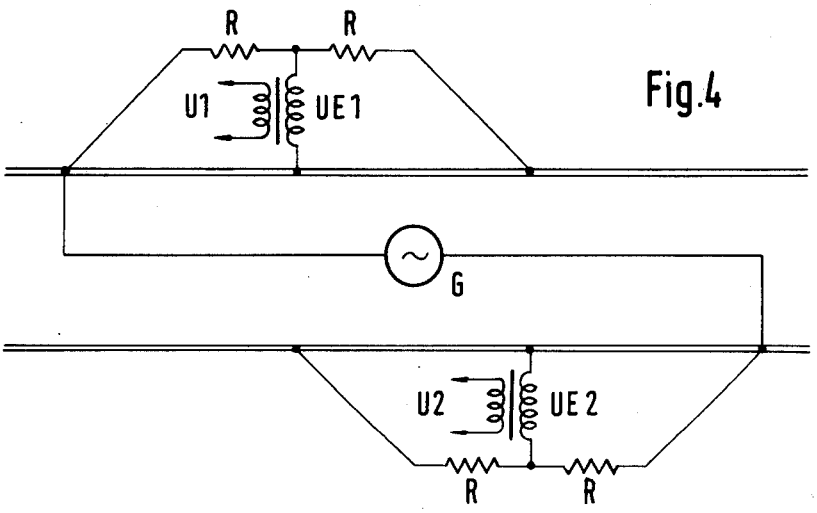
FIG. 4 shows a third embodiment of two sensor arrangements according to the principles of the present invention displaced relative to one another including resistors.

FIGS. 3 and 4 show variants of the sensor arrangements according to the present invention. The arrangement of FIG. 3 differs from that of FIG. 1 in the choice of the feed points for the alternating current G and in that two bonds or connections SV1 and SV2 between the rails are installed in the immediate vicinity of the sensor arrangements to limit the range of the alternating current. One of the sensor arrangements is included in the circuit on the left of the alternating-current source G, while the other is included in the circuit on the right of source G. This gives a better symmetry of the two circuits and, hence, a more uniform utilization of the power available from the alternating-current source G.

FIG. 4 shows sensor arrangements according to the present invention with resistors in the shunt path. Here power is fed in at the most distant points of the two sensor arrangements. This type of feed reduces the influence exerted by axles adjacent to an influence-exerting axle because shunt circuits formed by these axles, which load the alternating-current source G, become higher impedance.

Figure 5:
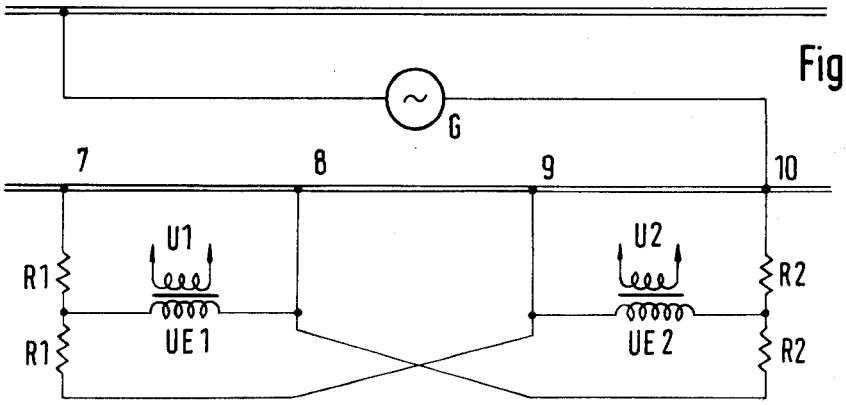
FIG. 5 shows a fourth embodiment of two overlapping sensor arrangements according to the principles of the present invention arranged along one rail.

FIG. 5 shows two sensor arrangements which are both associated with one rail and overlap one another. The bridge resistances of the first sensor arrangement are represented by the two resistors designated R1 and by the resistances of the rail portions between the rail points 7 and 8 and the rail points 8 and 9. The bridge resistances of the second sensor arrangement are represented by the resistors designated R2 and by the resistances of the rail portions between the points 8 and 9 and the points 9 and 10. Since the rail portion between the points 8 and 9 is used for both sensor arrangements, two rail terminals are saved. In addition, since all rail terminals except one are located on the same side of the track, the number of connecting cables in the track, which are obstructive during track construction work, is reduced.

The evaluation of the signal voltages is performed in an evaluating circuit in the known manner by comparing the respective signal voltage with a threshold voltage ($U_S$ in FIG. 1). When the threshold voltage is exceeded, a pulse indicating the presence of an axle is provided. The order of the presence pulses is interpreted in a simple logic circuit to provide an indication of direction of movement of the axle and, hence, the vehicle arrangement according to the present invention is particularly reliable if signals are subjected to phase-conscious rectification before being processed. Also, in the uninfluenced condition of the sensor arrangement, it may be advantageous to have, instead of a zero signal, a defined closed-circuit voltage in phase or in antiphase with the signal voltage. This can be achieved by slightly unbalancing the bridge on purpose.

While I have described above the principles of my invention in connection with specific apparatus it is to be clearly understood that this description is made only by way of example and not as a limitation to the scope of my invention as set forth in the objects thereof and in the accompanying claims.

I claim:

1. A sensor arrangement for detecting the presence of a single axle of a rail vehicle in a short length of a track having two rails comprising:

a first shunt path having two ends each coupled to a different one of first and second points spaced along one of said two rails within said short length of said track;

a first transformer having a first secondary winding and a first primary winding having one end thereof connected to a third point on said one of said two rails between said first and second points and the other end thereof connected to said first shunt path to provide one diagonal of a first bridge circuit including electrical resistances of said first shunt path and electrical resistances of said one of said two rails between said first and second points;

an alternating-current source connected between said two rails to provide the other diagonal of said first bridge circuit and to feed alternating current having a predetermined frequency into said first bridge; and said first secondary winding having a first alternating-voltage signal developed thereacross when said first bridge is unbalanced by a wheel of said axle being present between said first and second points.

2. A sensor arrangement according to claim 1, wherein said first shunt path includes two resistors in series and said other end of said first primary winding is connected between said two resistors.

3. A sensor arrangement according to claim 1, wherein said first shunt path includes a choke having a tap disposed therealong and said other end of said first primary winding is connected to said tap.

4. A sensor arrangement according to claims 1, 2 or 3, wherein the connection of said source to said one of said two rails and the connection of said source to the other of said two rails are displaced relative to one another.

5. A sensor arrangement according to claim 4, further including two spaced connections between said two rails to define said short length of said track.

6. A sensor arrangement according to claims 1, 2 or 3, further including two spaced connections between said two rails to define said short length of said track.

7. A sensor arrangement according to claims 1, 2 or 3, further including a second shunt path having two ends each coupled to a different one of fourth and fifth points spaced along the other of said two rails within said short length of said track;

a second transformer having a second secondary winding and a second primary winding having one end thereof connected to a sixth point on said other of said two rails between said fourth and fifth points and the other end thereof connected to said second shunt path to provide one diagonal of a second bridge circuit including electrical resistances of said second shunt path and electrical resistances of said other of said two rails between said fourth and fifth points, said source providing the other diagonal of said second bridge circuit and feeding said alternating current into said second bridge circuit;

said second secondary winding having a second alternating-voltage signal developed thereacross when said second bridge circuit is unbalanced by a wheel of said axle being present between said fourth and fifth points; and the order in which said first and second alternating-voltage signals are developed across said first and second secondary windings giving an indication of the direction of movement of said vehicle.

8. A sensor arrangement according to claim 7, wherein the connection of said source to said one of said two rails and the connection of said source to the other of said two rails are displaced relative to one another.

9. A sensor arrangement according to claim 7, further including two spaced connections between said two rails to define said short length of said track.

10. A sensor arrangement according to claim 7, wherein said second shunt path includes two resistors in series and said other end of said secondary primary winding is connected between said two resistors.

11. A sensor arrangement according to claim 10, wherein the connection of said source to said one of said two rails and the connection of said source to the other of said two rails are displaced relative to one another.

12. A sensor arrangement according to claim 10, further including two spaced connections between said two rails to define said short length of said track.

13. A sensor arrangement according to claim 7, wherein said second shunt path includes a choke having a tap disposed therealong and said other end of said second primary winding is connected to said tap.

14. A sensor arrangement according to claim 13, wherein the connection of said source to said one of said two rails and the connection of said source to the other of said two rails are displaced relative to one another.

15. A sensor arrangement according to claim 13, further including two spaced connections between said two rails to define said short length of said track.

16. A sensor arrangement according to claims 1, 2 or 3, further including a second shunt path having two ends each coupled to a different one of fourth and fifth points spaced along said one of said two rails within said short length of said track, said fourth and fifth points being different than said first and second points;

a second transformer having a second secondary winding and a second primary winding having one end thereof connected to said one of said two rails within said short length of said track and the other end thereof connected to said second shunt path to provide one diagonal of a second bridge circuit including electrical resistances of said second shunt path and electrical resistances of said one of said two rails between said fourth and fifth points, said source providing the other diagonal of said second bridge circuit and feeding said alternating current into said second bridge circuit;

said second secondary winding having a second alternating-voltage signal developed thereacross when said second bridge circuit is unbalanced by a wheel of said axle being present between said fourth and fifth points; and the order in which said first and second alternating-voltage signals are developed across said first and second secondary windings giving an indication of the direction of movement of said vehicle.

17. A sensor arrangement according to claim 16, wherein said fourth point is coincident with said third point and said one end of said second primary winding is connected to said second point.

* * * * *